US010323650B2

(12) United States Patent
Kosaka et al.

(10) Patent No.: US 10,323,650 B2
(45) Date of Patent: Jun. 18, 2019

(54) CENTRIFUGAL BLOWER

(71) Applicant: DENSO CORPORATION, Kariya, Aichi-pref. (JP)

(72) Inventors: Syo Kosaka, Kariya (JP); Shuzo Oda, Kariya (JP)

(73) Assignee: DENSO CORPORATION, Kariya, Aichi-pref (JP)

( * ) Notice: Subject to any disclaimer, the term of this patent is extended or adjusted under 35 U.S.C. 154(b) by 217 days.

(21) Appl. No.: 15/334,432

(22) Filed: Oct. 26, 2016

(65) Prior Publication Data

US 2017/0130723 A1 May 11, 2017

(30) Foreign Application Priority Data

Nov. 9, 2015 (JP) ..... 2015-219752

(51) Int. Cl.
*F04D 29/68* (2006.01)
*F04D 29/42* (2006.01)
(Continued)

(52) U.S. Cl.
CPC ..... *F04D 29/4213* (2013.01); *F04D 29/4226* (2013.01); *F04D 29/681* (2013.01);
(Continued)

(58) Field of Classification Search
CPC .... F04D 29/684; F04D 29/681; F04D 29/667; F04D 29/444; F04D 29/4226;
(Continued)

(56) References Cited

U.S. PATENT DOCUMENTS 5,361,828 A * 11/1994 Lee ..... F01D 5/187 165/109.1
5,547,339 A * 8/1996 Burgers ..... F04D 29/4213 415/119
(Continued)

FOREIGN PATENT DOCUMENTS

JP S58-167798 U 11/1983
JP H8-247090 A 9/1996
(Continued)

OTHER PUBLICATIONS

G. Burseti, Bluff-Body Aerodynamics, Jun. 2000, University of Pisa Aerospace Engineering Department.*

*Primary Examiner* — David E Sosnowski
*Assistant Examiner* — Maranatha Boardman
(74) *Attorney, Agent, or Firm* — Harness, Dickey & Pierce, P.L.C.

(57) ABSTRACT

A centrifugal blower includes a rotation shaft, an impeller, a casing, and a deflection portion. The impeller rotates about the rotation shaft to draw an air therein in an axial direction of the rotation shaft and discharge the air outward in a radial direction of the rotation shaft. The impeller includes a plurality of blades and a side panel having an annular shape and connecting the plurality of blades in the axial direction. The casing accommodates the impeller and includes an air intake portion adjacent to the side panel. The air intake portion has a bell mouth shape to have a rim portion that defines an opening through which the drawn air is guided to an inside of the impeller. The deflection portion deflects an airflow along the rim portion of the air intake portion toward the side panel.

5 Claims, 17 Drawing Sheets

(51) Int. Cl.
*F04D 17/16* (2006.01)
*F04D 29/16* (2006.01)
*F04D 29/28* (2006.01)

(52) U.S. Cl.
CPC ..... *F04D 29/687* (2013.01); *F04D 17/16* (2013.01); *F04D 29/162* (2013.01); *F04D 29/282* (2013.01)

(58) Field of Classification Search
CPC ..... F04D 29/281; F04D 29/66; F04D 29/403; F01D 5/10; F01D 9/041; F05B 2260/96; F05B 2210/42
USPC ..... 415/206
See application file for complete search history.

(56) References Cited

U.S. PATENT DOCUMENTS

| | | | | |
|---|---|---|---|---|
| 9,157,455 | B2 * | 10/2015 | Bilodeau | F01P 5/06 |
| 2002/0067988 | A1 * | 6/2002 | Angelis | F04D 29/545 415/211.2 |
| 2010/0202887 | A1 * | 8/2010 | Bohl | F04D 29/162 416/183 |

FOREIGN PATENT DOCUMENTS

| | | | |
|---|---|---|---|
| JP | 2003-278696 | A | 10/2003 |
| JP | 2007-211708 | A | 8/2007 |
| JP | 2013-002428 | A | 1/2013 |
| JP | 2013-057298 | A | 3/2013 |
| JP | 2016-014368 | A | 1/2016 |
| JP | 2016-035230 | A | 3/2016 |
| JP | 2016-102467 | A | 6/2016 |

* cited by examiner

CENTRIFUGAL BLOWER

CROSS REFERENCE TO RELATED APPLICATION

This application is based on and incorporates herein by reference Japanese Patent Application No. 2015-219752 filed on Nov. 9, 2015.

TECHNICAL FIELD

The present disclosure relates to a centrifugal blower.

BACKGROUND

Conventionally, a centrifugal blower, which draws air therein from one side of an axial direction of a rotation shaft and discharges the air outward in a radial direction of the rotation shaft, is known.

Patent Document 1 (JP H8-247090) discloses a blowing property of the centrifugal blower and a configuration for reducing noise. Patent Document 1 discloses a configuration in which small protrusions are arranged concentrically to an intake ring on a surface of an inflow portion of the intake ring inserted into an intake portion of an impeller. A height of the small protrusions is smaller than a thickness of a boundary layer of a laminar flow.

According to the configuration disclosed in Patent Document 1, since a difference in velocity between an airflow along a surface of the intake ring and a main current distant from the surface of the intake ring is small, the turbulence of an airflow separated from the surface of the intake ring is also small.

According to a consideration by the inventors of the present disclosure, since the intake ring and a side panel are not continuously connected to each other in the configuration disclosed in Patent Document 1, the airflow along the surface of the intake ring may be separated at an end portion of the intake ring on a downstream side and may not flow along the side panel. Accordingly, air flowing from the surface of the intake ring into a vicinity of the side panel of the impeller may be disturbed. The turbulent flow generated in the vicinity of the side panel of the impeller may grow as the turbulent flow moves downstream, and accordingly the noise may increase, and the blowing effectiveness may decrease.

SUMMARY

It is an objective of the present disclosure to provide a centrifugal blower capable of reducing noise and improving blowing effectiveness.

According to an aspect of the present disclosure, a centrifugal blower includes a rotation shaft, an impeller, a casing, and a deflection portion. The impeller has a circular cylindrical shape and rotates about an axis line of the rotation shaft to draw air therein in an axial direction of the rotation shaft and discharge the air outward in a radial direction of the rotation shaft. The impeller includes a plurality of blades arranged radially about the rotation shaft, and a side panel having an annular shape and connecting end parts of the plurality of blades in the axial direction of the rotation shaft. The casing accommodates the impeller and includes an air intake portion positioned adjacent to the side panel. The air intake portion has a bell mouth shape to have a rim portion that defines an opening through which the drawn air is guided to an inside of the impeller. The deflection portion deflects an airflow along the rim portion of the air intake portion toward the side panel.

According to this, a separation of the airflow along a surface of the air intake portion and a separation of air flowing into a vicinity of the side panel can be limited by deflecting the airflow along the surface of the air intake portion toward the side panel. Therefore, the turbulence of the air flowing from the rim portion of the air intake portion into the vicinity of the side panel of the impeller can be limited.

Accordingly, the centrifugal blower can be obtained, which is capable of reducing noise due to the turbulence of the airflow around the side panel of the impeller and improving blowing effectiveness. The air intake portion having a bellmouth shape means that the air intake portion in which a diameter of the rim portion increases smoothly toward an upstream of the air like a trumpet.

BRIEF DESCRIPTION OF THE DRAWINGS

The disclosure, together with additional objectives, features and advantages thereof, will be best understood from the following description, the appended claims and the accompanying drawings, in which:

DETAILED DESCRIPTION

Figure 1:
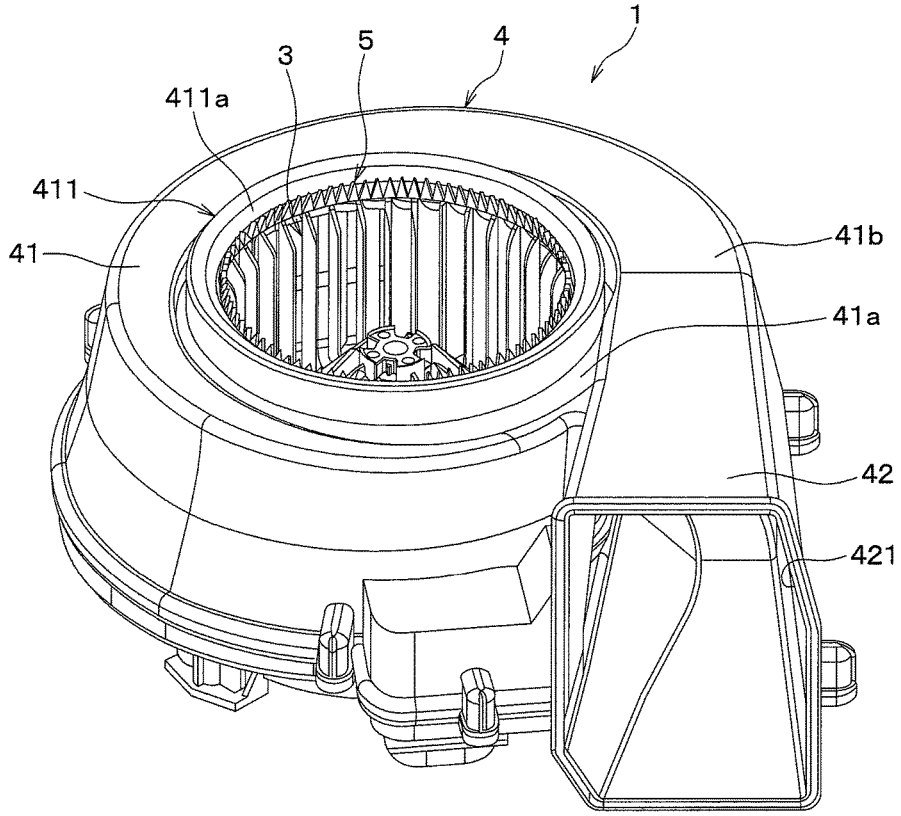
FIG. 1 is a diagram illustrating a centrifugal blower according to a first embodiment of the present disclosure.

Embodiments of the present disclosure will be described hereinafter referring to drawings. In the embodiments, a part that corresponds to a matter described in a preceding embodiment may be assigned with the same reference numeral, and redundant explanation for the part may be omitted. When only a part of a configuration is described in an embodiment, another preceding embodiment may be applied to the other parts of the configuration. The parts may be combined even if it is not explicitly described that the parts can be combined. The embodiments may be partially combined even if it is not explicitly described that the embodiments can be combined, provided there is no harm in the combination.

First Embodiment

A centrifugal blower 1 according to a first embodiment will be described below referring to FIG. 1 to FIG. 8. The centrifugal blower 1 of the present embodiment shown in FIG. 1 is used in a blowing unit that blows air to an interior unit of an air conditioning device for a vehicle, for example.

Figure 2:
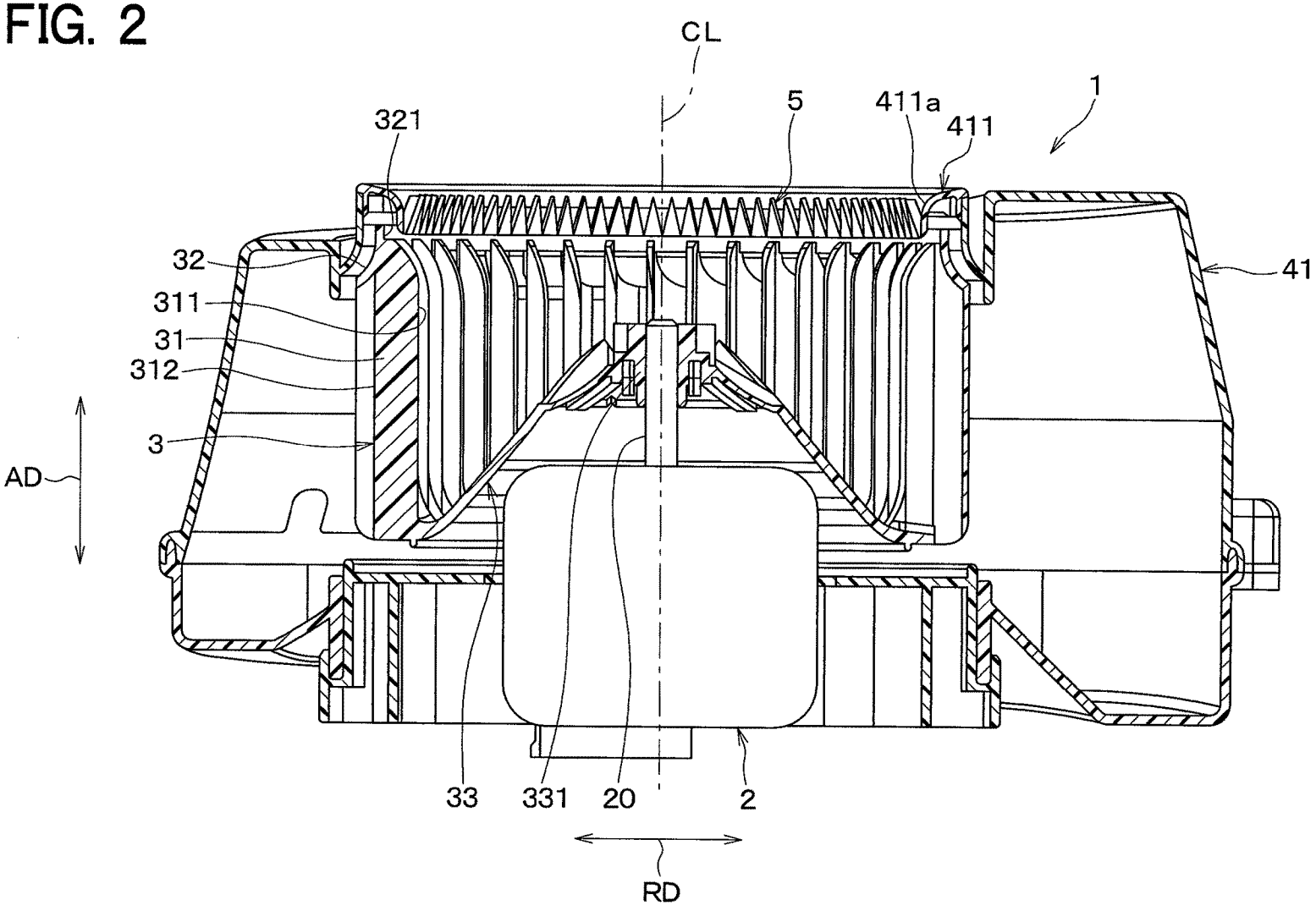
FIG. 2 is a sectional diagram illustrating the centrifugal blower according to the first embodiment.

As shown in FIG. 2, the centrifugal blower 1 includes an electric motor 2 having a rotation shaft 20, an impeller 3 driven and rotated by the electric motor 2 to blow air, and a casing 4 accommodating the impeller 3. An arrow AD shown in FIG. 2 represents an axial direction of the rotation shaft 20. An arrow RD shown in FIG. 2 represents a radial direction perpendicular to the axial direction AD of the rotation shaft 20.

The impeller 3 is a component rotating about an axial line CL of the rotation shaft 20, and the impeller 3 has a circular cylindrical shape. The impeller 3 includes a plurality of blades 31 arranged radially about the rotation shaft 20, a side panel 32 having an annular shape and linking a part of each blade 31 on one side (first side) in the axial direction AD with each other, and a main panel 33 having a disc shape and linking a part of each blade 31 on the other side (second side) in the axial direction AD.

The impeller 3 of the present embodiment includes a multi-blade centrifugal fan (sirocco fan) in which each blade 31 is a forward-curved blade. An air passage in which the air flows is provided between blades 31 next to each other. The blade 31 includes an inner edge portion 311 constituting an inflow portion of the air, and an outer edge portion 312 constituting an outflow portion of the air.

The side panel 32 is formed of a component having an annular shape in which a center part is open. The side panel 32 includes an introduction port 321 through which the air drawn from an air intake portion 411 of a casing 4 is introduced to the impeller 3. A part of the blade 31 on the one side in the axial direction AD is connected to an inner side of the side panel 32 facing to the main panel 33. The side panel 32 of the present embodiment is convex inward in the radial direction RD of the rotation shaft 20 such that the air flowing between blades 31 next to each other is guided outward in the radial direction RD.

The main panel 33 includes a boss portion 331. A center part of the boss portion 331 is connected to the rotation shaft 20. A part of the blade 31 on the other side in the axial direction AD is connected to an outer side of the main panel 33 facing to the side panel 32. The main panel 33 of the present embodiment has a circular conical surface shape that is convex toward the introduction port 321 in the axial direction AD of the rotation shaft 20. The shape of the main panel 33 may be a flat circle.

As shown in FIG. 1, the casing 4 includes a scroll portion 41 housing the impeller 3 and defining an air passage having a volute shape around the impeller 3, and a blowing portion 42 through which the scroll portion 41 is connected to an interior unit.

The air intake portion 411, which has a bell mouth shape to guide the air into the impeller 3, is provided in a part of the scroll portion 41 adjacent to the side panel 32 of the impeller 3 on the one side in the axial direction AD of the rotation shaft 20.

In the air intake portion 411 of the present embodiment, as shown in FIG. 2, an inner diameter of a rim portion 411*a* is smaller than an inner diameter of the side panel 32 of the impeller 3. A part of the rim portion 411*a* is located inside the impeller 3 so as to overlap with the side panel 32 in the radial direction RD of the rotation shaft 20. The rim portion 411*a* may define an opening through which the drawn air is guided to an inside of the impeller 3.

In the air intake portion 411 of the present embodiment, vertical vortex generating portions 5 are arranged on entire circumference of the rim portion 411*a*. The vertical vortex generating portion 5 constitutes a deflection portion deflecting the airflow along the rim portion 411*a* of the air intake portion 411 such that the airflow head for the side panel 32. The vertical vortex generating portion 5 will be described in detail later.

The blowing portion 42 is joined with the scroll portion 41 between a scroll start portion 41*a* and a scroll end portion 41*b*. The blowing portion 42 extends from the scroll end portion 41*b* in a direction of tangent line. The blowing portion 42 includes a discharge portion 421 discharging the air on a downstream of the airflow.

Figure 3:
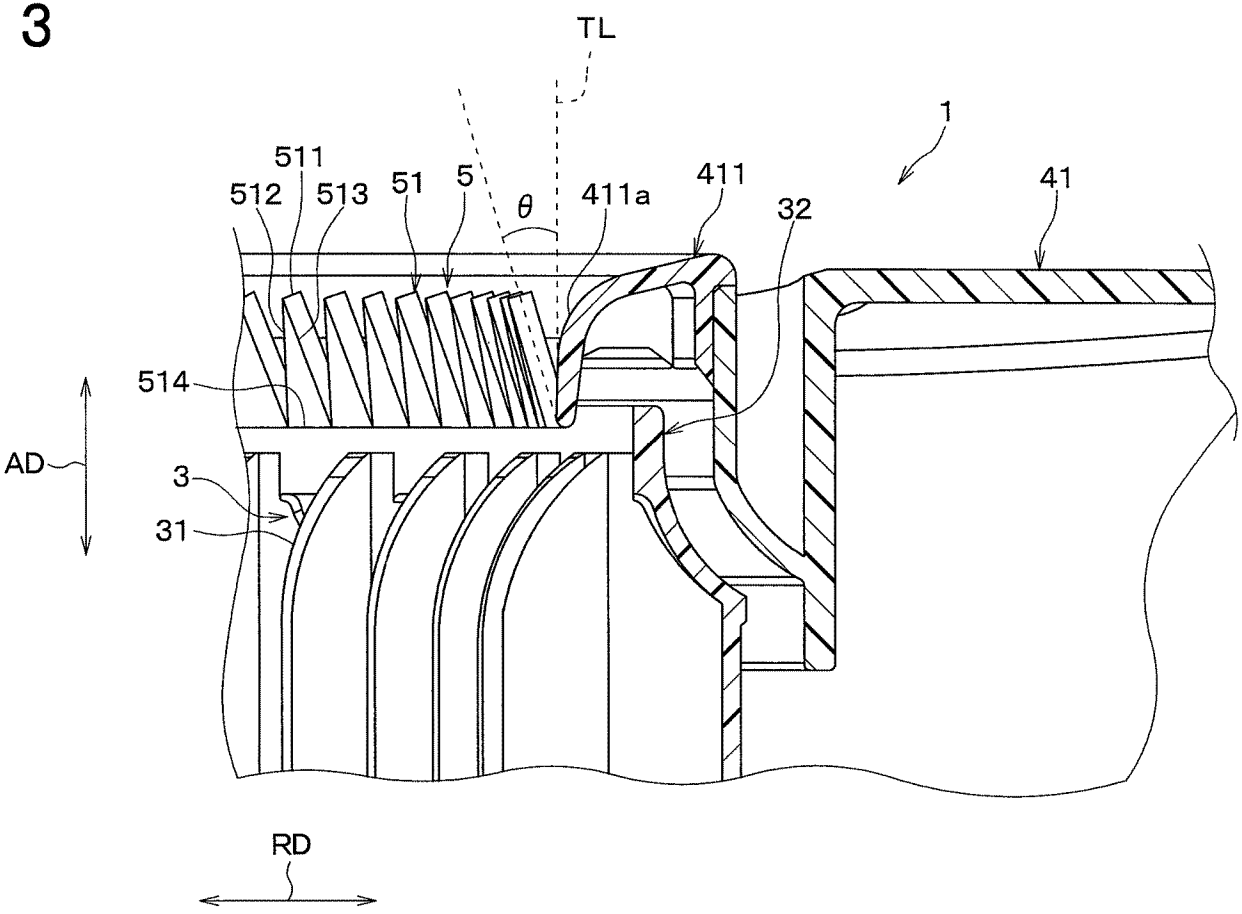
FIG. 3 is a sectional diagram illustrating the centrifugal blower according to the first embodiment.

Next, the vertical vortex generating portion 5 will be described below. The vertical vortex generating portion 5 is a component generating a vertical vortex having a spiral shape whose center axis of its rotation is along a direction in which a main current of the air flows in the air intake portion 411. As shown in FIG. 3, the vertical vortex generating portion 5 of the present embodiment includes the plurality of tooth portions 51, the tooth portion 51 having a triangle shape in which a width in a circumferential direction of the rotation shaft 20 decreases in size toward a top end (vertex).

A top end portion 511 of the tooth portion 51 in which two sides 512, 513 of the triangle shape intersect each other is located upstream of a base portion 514 contacting the rim portion 411*a* of the air intake portion 411. Specifically, each tooth portion 51 has a shape sharpened toward the top end portion 511. The tooth portion 51 protrudes toward an upstream of the airflow. The shape of the top end portion 511 of the tooth portion 51 is not limited to the sharp shape in which two sides 512, 513 are straight and intersects each other, but the top end portion 511 may be chamfered or rounded off. The base portion 514 may correspond to one side of the tooth portion 51 having a triangle shape other than the two sides 512, 513.

The tooth portion 51 is provided in the rim portion 411*a* of the air intake portion 411 in a state in which the tooth portion 51 is tilted such that the top end portion 511 is positioned in an inner position in the radial direction of the rotation shaft 20 compared to the base portion 514. Specifically, a distance between the tooth portion 51 and a tangent line TL of the rim portion 411*a* of the air intake portion 411 increases toward the top end portion 511. The tooth portion 51 is provided in the rim portion 411*a* of the air intake portion 411 in a state where the tooth portion 51 is angled at an acute angle θ with respect to the tangent line TL of the rim portion 411*a*. The base portion 514 of the tooth portion 51 of the present embodiment is connected to an end portion of the rim portion 411*a* of the air intake portion 411 on the downstream of the airflow.

The tooth portion 51 of the present embodiment has an isosceles triangle shape in which lengths of two sides 512, 513 intersecting at the top end portion 511 are equal to each other. A pair of vertical vortexes generated when the airflow passes the two sides 512 and 513 becomes likely to unite with each other by providing the tooth portion 51 in the isosceles triangle shape, and thus the vertical vortex may become stronger. The isosceles triangle shape is preferable as the shape of the tooth portion 51, but another triangle shape may be acceptable.

Next, actuations of the centrifugal blower 1 of the present embodiment will be described below. In the centrifugal blower 1, the impeller 3 rotates according to a rotation of the rotation shaft 20 of the electric motor 2. Accordingly, the air drawn into the impeller 3 from the air intake portion 411 on one side of the axial direction AD of the rotation shaft 20 is blown outward in the radial direction of the rotation shaft 20 by centrifugal force.

Figure 4:
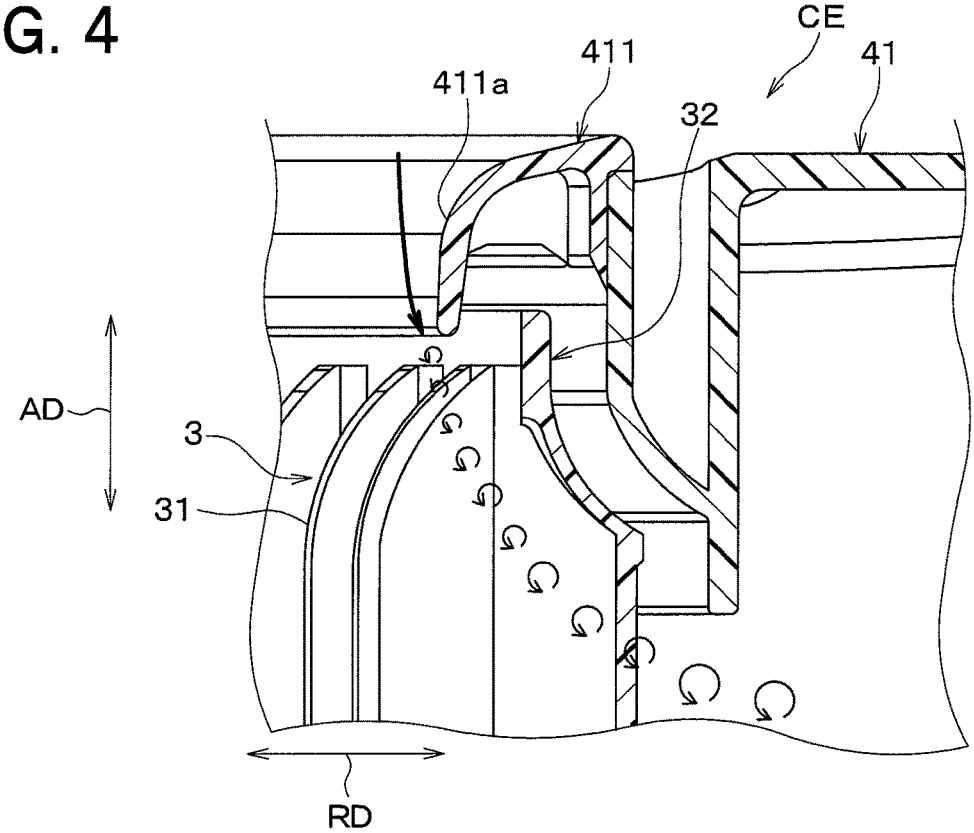
FIG. 4 is a diagram illustrating an airflow around an air intake portion of a centrifugal blower according to a comparative example.
Figure 5:
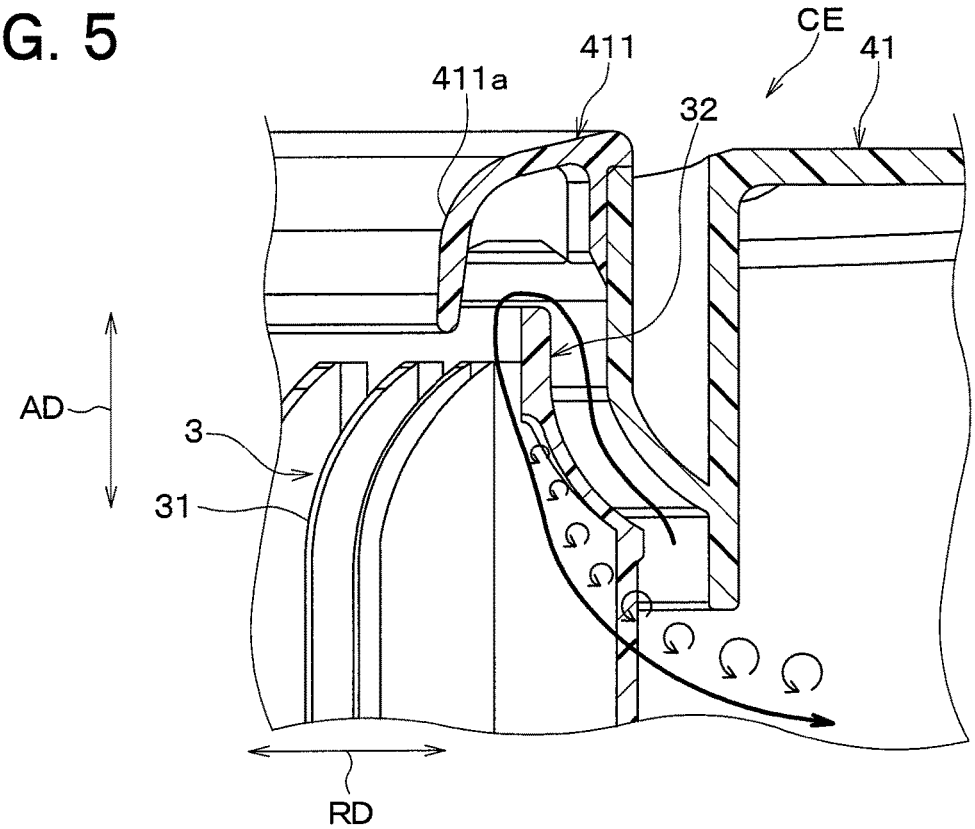
FIG. 5 is a diagram illustrating an airflow around a side panel of a centrifugal blower according to the comparative example.

FIG. 4 is a diagram illustrating an airflow in a vicinity of an air intake portion 411 of a centrifugal blower CE according to a comparative example. FIG. 5 is a diagram illustrating an airflow in a vicinity of a side panel 32 of the centrifugal blower CE according to the comparative example. The centrifugal blower CE of the comparative example is different from the centrifugal blower 1 of the present embodiment in only one point where the vertical vortex generating portion 5 is not provided in the air intake portion 411. In FIGS. 4 and 5, same reference numbers as the present embodiment are applied to configurations of the centrifugal blower CE of the comparative example similar to the centrifugal blower 1 of the first embodiment, for convenience.

In the centrifugal blower CE of the comparative example, air is drawn in an impeller 3 from the air intake portion 411 on one side in an axial direction AD of a rotation shaft 20 by a rotation of the rotation shaft 20, as shown in FIG. 4. The airflow along the air intake portion 411 is separated from a surface of the air intake portion 411 at an end portion of the air intake portion 411 on a downstream side of the airflow. Accordingly, the turbulence accompanied by a parallel vortex is generated in the air flowing into the vicinity of the side panel 32 of the impeller 3 from the surface of the air intake portion 411. The turbulence grows as the airflow moves to the downstream side in the impeller 3. Consequently, noise increases, and blowing effectiveness decreases. The parallel vortex is a vortex having a center axis of a rotation intersecting a flow direction of a main current of the air.

In the centrifugal blower CE of the comparative example, air returned through a gap between the air intake portion 411 and the side panel 32 flows into the vicinity of the side panel 32, as shown in FIG. 5. The air returned through the gap is separated at a middle portion of the side panel 32. Accordingly, the turbulence accompanied by the parallel vortex is generated also in the airflow returned through the gap between the air intake portion 411 and the side panel 32. This turbulence also grows as the airflow moves to the downstream side in the impeller 3. Consequently, the noise increases, and the blowing effectiveness decreases.

Figure 6:
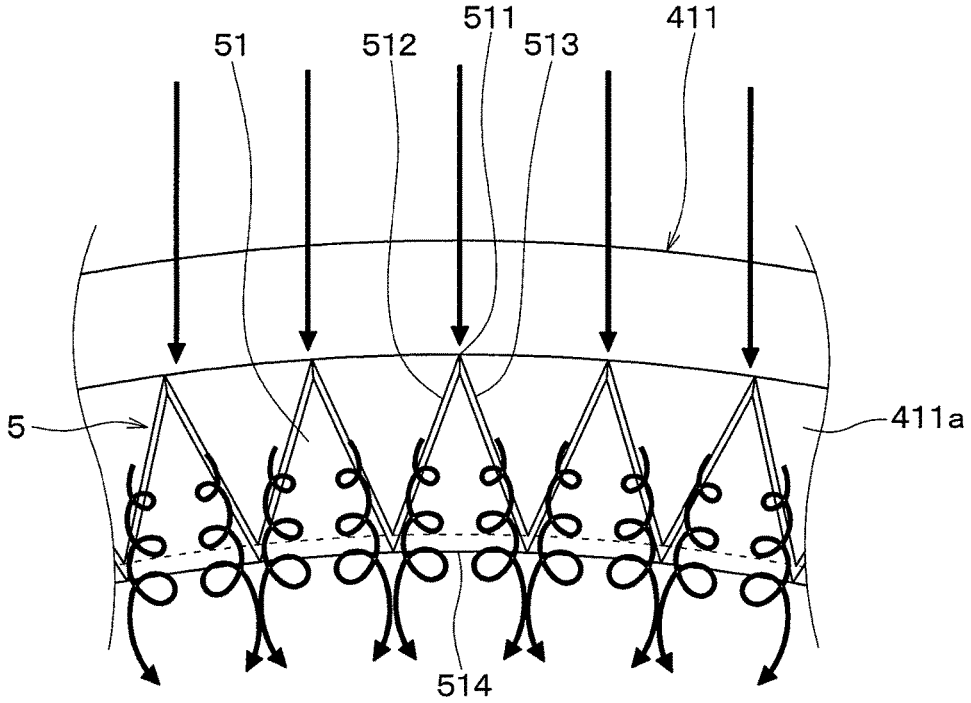
FIG. 6 is a diagram illustrating an airflow around each tooth portion of a vertical vortex generating portion.

On the other hand, in the centrifugal blower 1 of the present embodiment, the vertical vortex generating portion 5 is provided in the rim portion 411*a* of the air intake portion 411. Accordingly, in the centrifugal blower 1 of the present embodiment, the vertical vortex is generated at the vertical vortex generating portion 5 when the airflow along the surface of the air intake portion 411 flows through the two sides 512, 513 of the tooth portion 51, as shown in FIG. 6.

Figure 7:
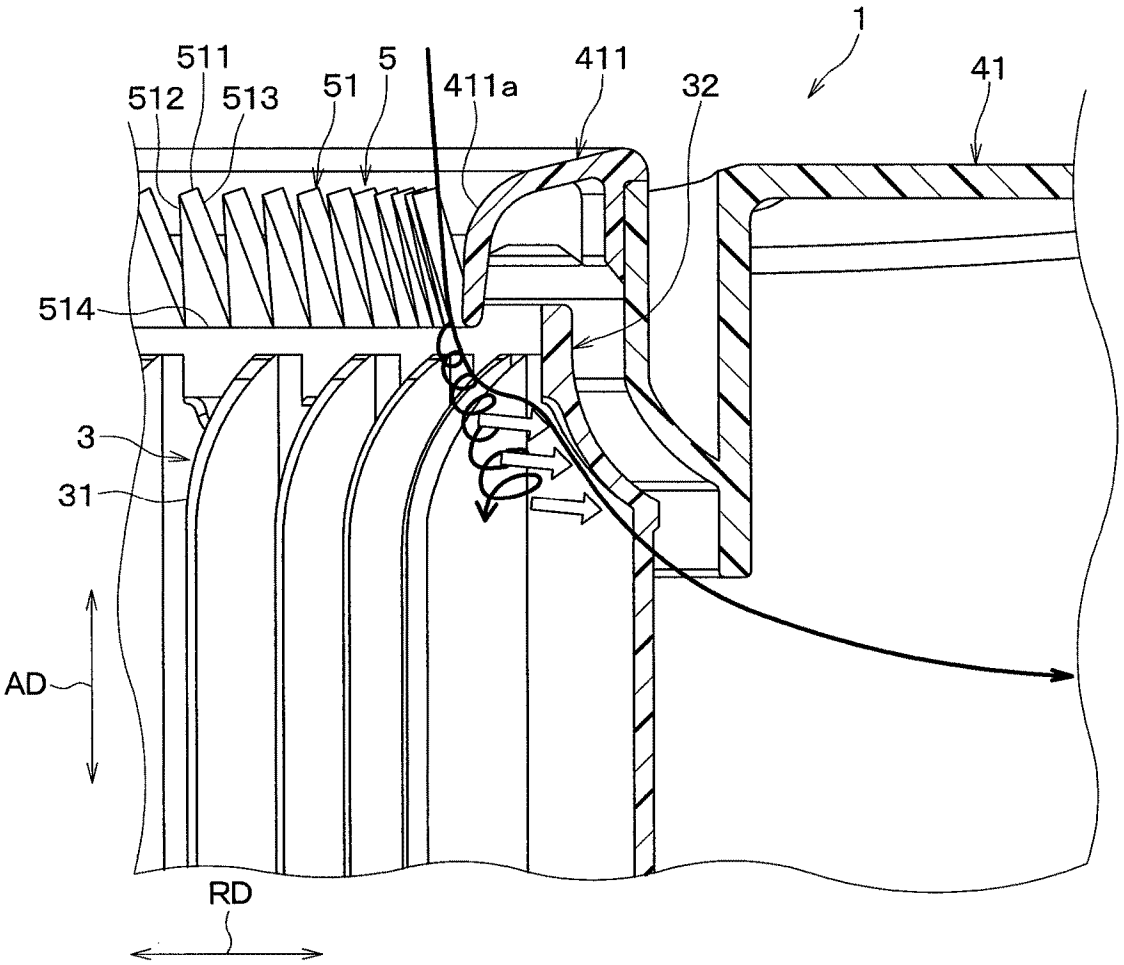
FIG. 7 is a diagram illustrating an airflow around a side panel of the centrifugal blower according to the first embodiment.

The air flowing into the vicinity of the side panel 32 from the surface of the air intake portion 411 is pushed against the side panel 32, as shown in FIG. 7. Similarly, the airflow returned through the gap between the air intake portion 411 and the side panel 32 is also pushed against the side panel 32 by the vertical vortex. Accordingly, the air flowing into the vicinity of the side panel 32 flows along the side panel 32 without separation from the side panel 32. Since the centrifugal blower 1 of the present embodiment is capable of limiting the turbulence of the airflow in the vicinity of the side panel 32, the noise in the centrifugal blower 1 can be decreased.

Since the turbulence of the airflow in the vicinity of the side panel 32 is limited, a difference in velocity between the airflow around the side panel 32 and the airflow around the main panel 33 of the impeller 3 becomes small. Consequently, the blowing effectiveness of the centrifugal blower 1 can be improved.

The centrifugal blower 1 of the present embodiment described above includes the vertical vortex generating portion 5 as the deflection portion that deflects the airflow along the rim portion 411*a* of the air intake portion 411 toward the side panel 32 of the impeller 3.

According to this configuration that deflects the airflow along the surface of the air intake portion 411 of the casing 4 toward the side panel 32, the separation of the airflow along the surface of the air intake portion 411 and the separation of the air flowing into the vicinity of the side panel 32 can be limited. Accordingly, the turbulence of the air flowing into the vicinity of the side panel 32 of the impeller 3 from the rim portion 411*a* of the air intake portion 411 can be limited.

Therefore, the centrifugal blower 1 of the present embodiment can reduce the noise due to the turbulence of the airflow in the vicinity of the side panel 32 of the impeller 3, and the centrifugal blower 1 can improve the blowing effectiveness.

In the present embodiment, the vertical vortex generating portion 5 is provided in the rim portion 411*a* of the air intake portion 411. According to this, since the air on the downstream side of the air intake portion 411 is pushed against the side panel 32 by the vertical vortex generated in the rim portion 411*a* of the air intake portion 411, the separation of the airflow from the side panel 32 and the air intake portion 411 can be limited further.

Specifically in the present embodiment, the vertical vortex generating portion 5 is constituted by the plurality of tooth portions 51 having the triangle shape. According to this, the vertical vortex can be generated at the two sides 512, 513 of the tooth portion 51 when the air flowing along the rim portion 411*a* of the air intake portion 411 passes the tooth portion 51.

Figure 8:
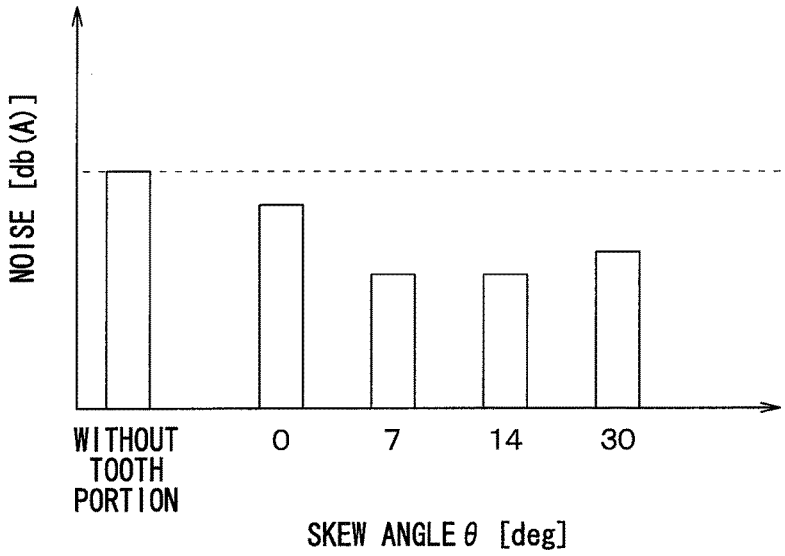
FIG. 8 is a diagram illustrating an effect on reducing noise of the centrifugal blower according to the first embodiment.

FIG. 8 shows a result of a measurement of loudness of the noise. In the measurement, a skew angle between the tooth portion 51 and the tangent line TL of the rim portion 411*a* of the air intake portion 411 is varied.

As shown in FIG. 8, the noise is loudest when no vertical vortex generating portion is provided like the comparative example. When the vertical vortex generating portion 5 is provided, and when the skew angle is set within 7 to 14 degrees, the noise reduction effect is large. Therefore, the skew angle is preferably set within 7 to 14 degrees.

Figure 9:
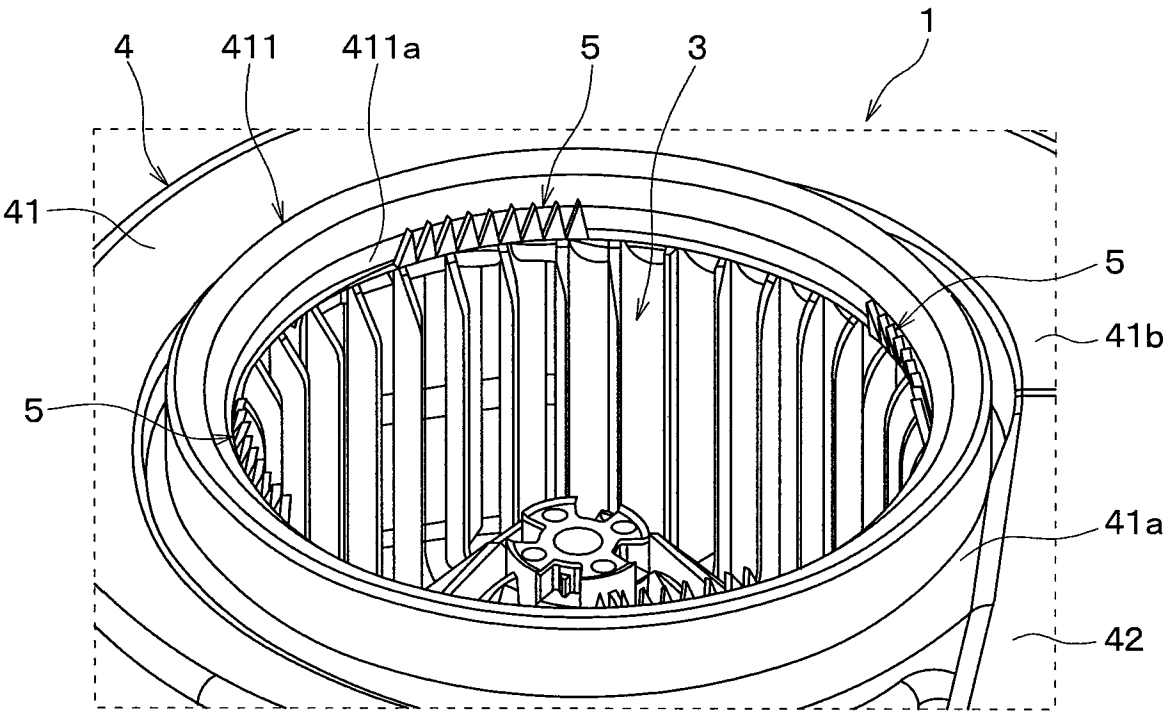
FIG. 9 is a diagram illustrating a modification of the centrifugal blower according to the first embodiment.

In the above-described embodiment, an example in which the vertical vortex generating portions 5 are arranged on the entire circumference of the rim portion 411*a* of the air intake portion 411 is described. However, the distribution of the vertical vortex generating portion 5 is not limited to this. For example, the vertical vortex generating portion 5 may be provided in a part of the rim portion 411*a* of the air intake portion 411 as shown in FIG. 9.

A connection portion in which the scroll start portion 41*a* of the scroll portion 41 and the blowing portion 42 are connected to each other corresponds to a part of the scroll portion 41 in which the scroll start portion 41*a* and the scroll end portion 41*b* communicate with each other. Since the connection portion corresponds to a portion in which the air flowing in the scroll end portion 41*b* of the scroll portion 41, the air flowing back from the scroll start portion 41*a*, and the air discharged from the impeller 3 are joined together, the airflow in the connection portion is most likely to be disturbed in the casing 4. Accordingly, the vertical vortex generating portion 5 is preferably provided at least in the connection portion in which the scroll start portion 41*a* of the scroll portion 41 and the blowing portion 42 are connected to each other.

Second Embodiment

Next, a second embodiment of the present disclosure will be described below referring to FIGS. 10 to 13. This embodiment is different from the first embodiment in a point where vertical vortex generating portions 5 are formed of a plurality of protrusion portions 52, the protrusion portion 52 having a three sided pyramid shape.

Figure 10:
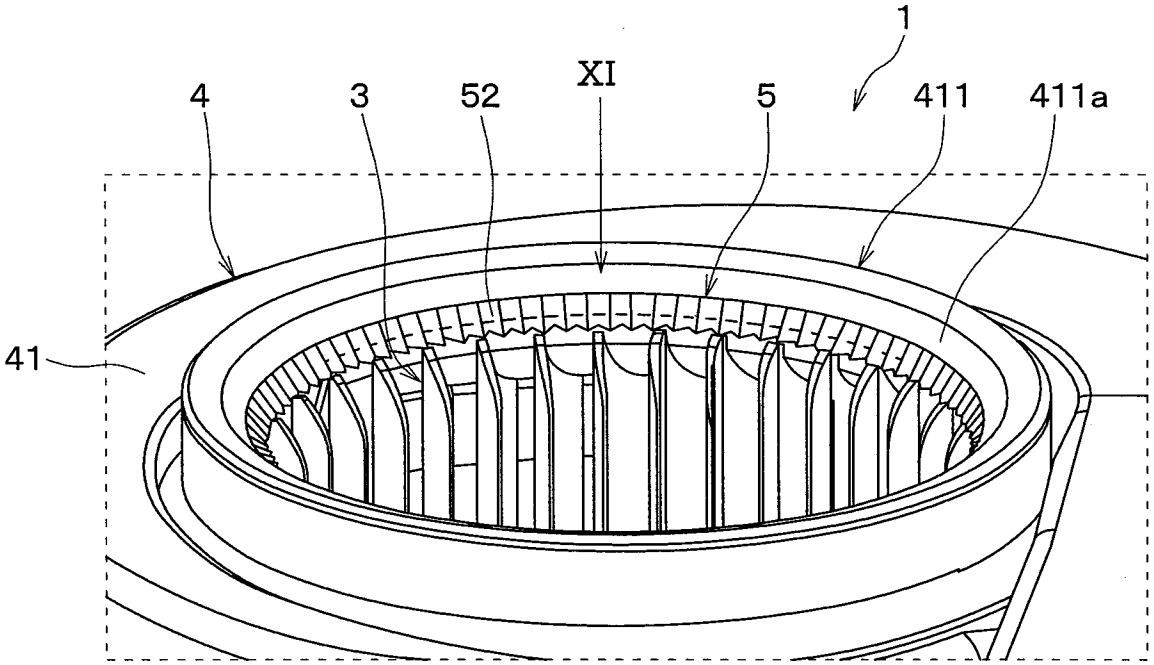
FIG. 10 is a diagram illustrating a centrifugal blower according to a second embodiment of the present disclosure.
Figure 11:
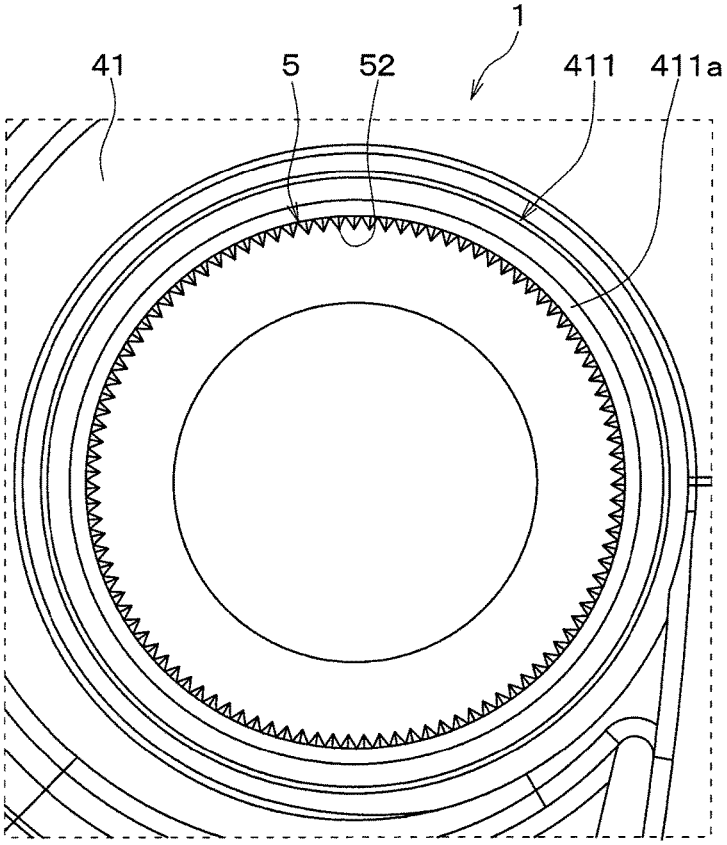
FIG. 11 is a diagram illustrating the centrifugal blower viewed in a direction represented by an arrow XI of FIG. 10, according to the second embodiment.
Figure 12:
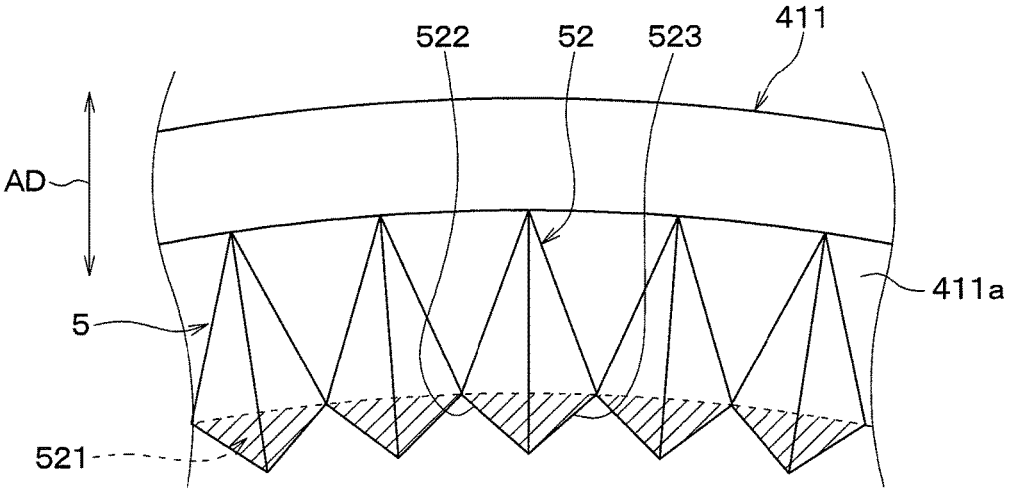
FIG. 12 is a diagram illustrating the centrifugal blower according to the second embodiment.

As shown in FIGS. 10 and 11, a centrifugal blower 1 of the present embodiment includes the vertical vortex generating portions 5 formed of the plurality of protrusion portions 52 arranged on entire circumference of a rim portion 411*a* of an air intake portion 411. As shown in FIG. 12, the vertical vortex generating portion 5 of the present embodiment is formed of the protrusion portion 52 having a three sided pyramid shape that protrudes inward in a radial direction of a rotation shaft 20 from the rim portion 411*a* of the air intake portion 411.

Each protrusion portion 52 includes two sides 522, 523 in a downstream surface 521 positioned downstream of an airflow, the two edges intersecting a main current of air. The two sides 522, 523 may correspond to two edges of the three sided pyramid shape. A protrusion height of the protrusion portion 52 of the present embodiment, which is a dimension of the protrusion portion 52 in the radial direction of the rotation shaft 20, becomes large toward a downstream of the airflow. A width of the protrusion portion 52 in a circumferential direction of the rotation shaft 20 becomes large toward the downstream of the airflow. The protrusion portion 52 may have a vertex at which three surfaces of the protrusion portion 52 other than a bottom surface contacting the rim portion 411*a* intersect each other. The vertex may be located downstream of the bottom surface in a flow direction of the air.

The other configurations are the same as the first embodiment. Next, actuations of the centrifugal blower 1 of the present embodiment will be described below. In the centrifugal blower 1, an impeller 3 rotates according to a rotation of the rotation shaft 20 of an electric motor 2. According to this, air drawn into the impeller 3 from the air intake portion 411 that is located on one side in an axial direction AD of the rotation shaft 20 is blown out in the radial direction RD of the rotation shaft 20 by centrifugal force.

Figure 13:
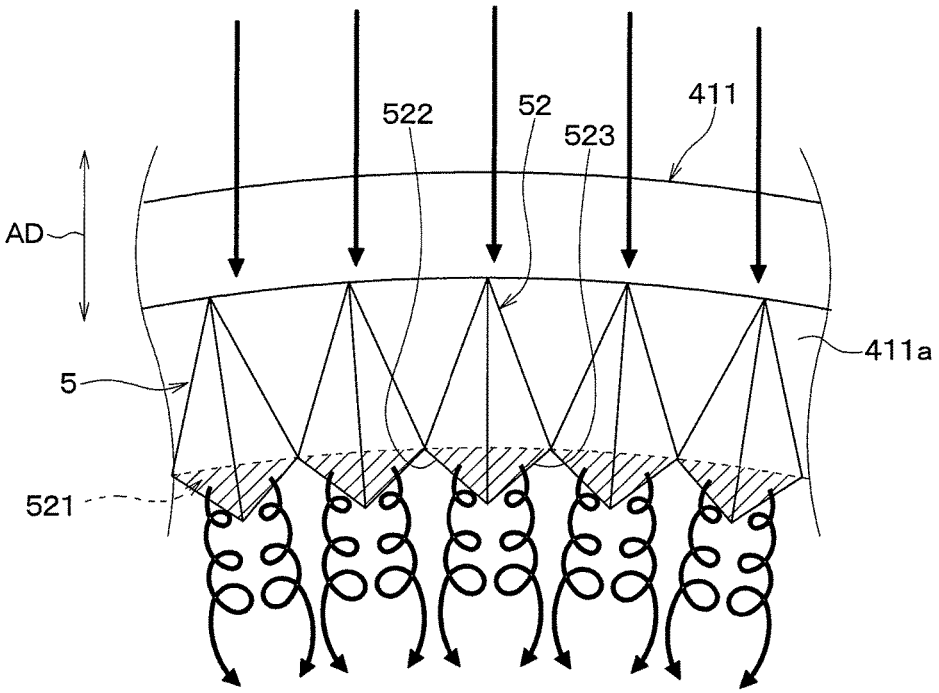
FIG. 13 is a diagram illustrating an airflow around each tooth portion of a vertical vortex generating portion according to the second embodiment.

In the centrifugal blower 1 of the present embodiment, a vertical vortex is generated around the vertical vortex generating portion 5 when the airflow along an surface of the air intake portion 411 passes the two sides 522, 523 of each protrusion portion 52 as shown in FIG. 13.

Air flowing into a vicinity of a side panel 32 from the surface of the air intake portion 411 and air returned through a gap between the air intake portion 411 and the side panel 32 are pushed against the side panel 32. Therefore, the air flowing into the vicinity of the side panel 32 flows along the side panel 32 without being separated from the side panel 32.

The centrifugal blower 1 of the present embodiment is capable of limiting the turbulence of the airflow in the vicinity of the side panel 32 by the vertical vortex generated by the vertical vortex generating portion 5, similarly to the first embodiment. Therefore, the centrifugal blower 1 is capable of reducing noise caused by the turbulence of the airflow in the vicinity of the side panel 32 of the impeller 3, and accordingly the centrifugal blower 1 is capable of improving blowing effectiveness.

The vertical vortex generating portions 5 are arranged on entire circumference of the rim portion 411*a* of the air intake portion 411. However, the distribution of the vertical vortex generating portion 5 is not limited to this. The vertical vortex generating portion 5 may be provided in a part of the rim portion 411*a* of the air intake portion 411, for example.

Third Embodiment

Figure 14:
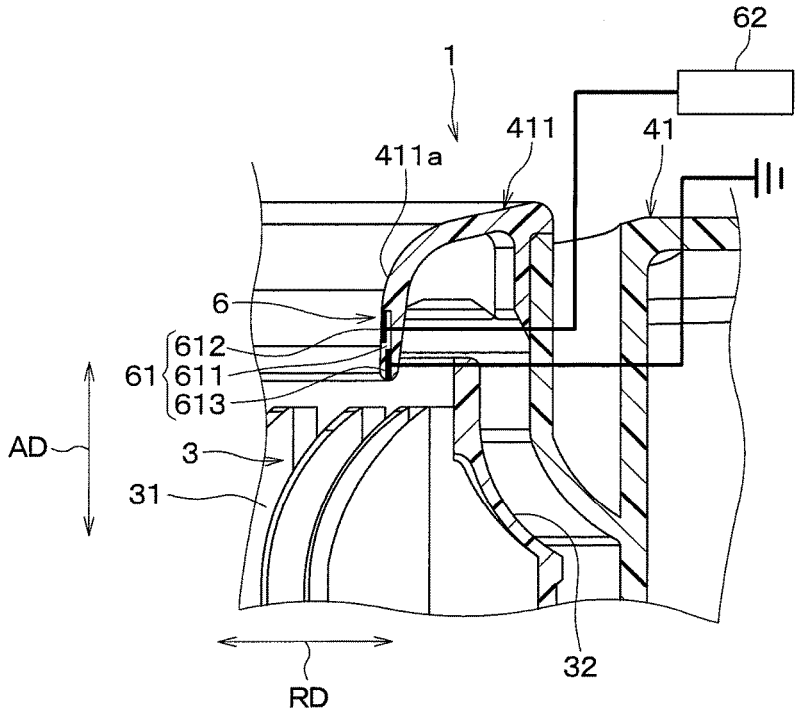
FIG. 14 is a diagram illustrating a centrifugal blower according to a third embodiment of the present disclosure.
Figure 15:
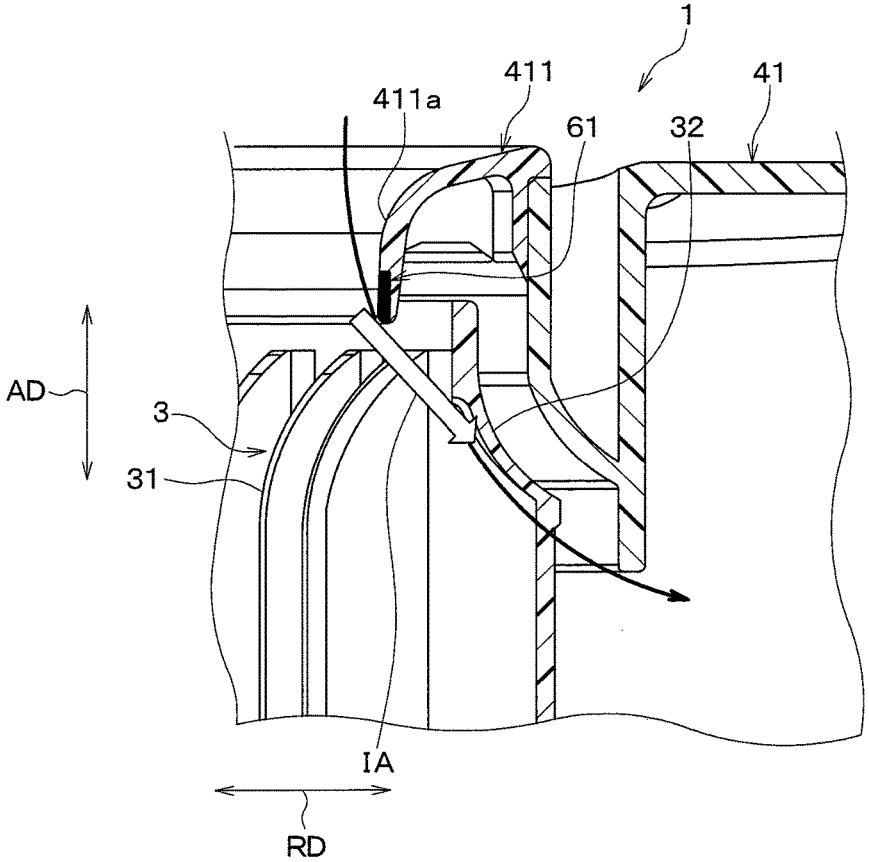
FIG. 15 is a diagram illustrating an airflow round a side panel of the centrifugal blower according to the third embodiment.

Next, a third embodiment will be described below referring to FIGS. 14 and 15. The present embodiment is different from the first embodiment in a point in which a deflection portion deflecting an airflow along a rim portion 411*a* of an air intake portion 411 to a side panel 32 is formed of a plasma actuator 6.

The plasma actuator 6 is an actuator generating an induced airflow toward the side panel of an impeller 3 by generating a plasma in the rim portion 411*a* of the air intake portion 411.

The plasma actuator 6 includes a device 61 having a non-conductive body 611, a first side electrode 612 provided in a first side of the non-conductive body 611, and a second side electrode 613 provided in a second side of the non-conductive body 611. The second side may be a reverse side of the first side. The plasma actuator 6 further includes an alternating current supplying portion 62 that supplies an alternating-current voltage between the first side electrode 612 and the second side electrode 613 of the device 61.

The device 61 is entirely provided in a circumference of the rim portion 411*a* of the air intake portion 411. The device 61 is embedded in the rim portion 411*a* of the air intake portion 411 such that a step is not formed between the device 61 and a surface of the air intake portion 411.

The other configurations are same as the first embodiment. Next, actuations of the centrifugal blower 1 of the present embodiment will be described below. In the centrifugal blower 1 of the present embodiment, an alternating-current voltage having several kHz and several kV is supplied between the first side electrode 612 and the second side electrode 613 by the alternating current supplying portion 62 when the rotation shaft 20 of the electric motor 2 is rotated.

When the impeller 3 rotates according to the rotation of the rotation shaft 20 of the electric motor 2 in the centrifugal blower 1, air drawn into the impeller 3 from the air intake portion 411 on one side of an axial direction AD of the rotation shaft 20 is blown outward in a radial direction RD of the rotation shaft 20 by centrifugal force.

In this time, a plasma jet is generated from an end portion of the first side electrode 612 along a surface of the non-conductive body 611. According to this, air around the rim portion 411*a* of the air intake portion 411 is moved toward the device 61 as shown in FIG. 15, and the induced airflow IA from the rim portion 411*a* of the air intake portion 411 toward the side panel 32 of the impeller 3 is generated.

By the induced airflow IA, the air flowing into a vicinity of the side panel 32 from the surface of the air intake portion 411 and the air returned through a gap between the air intake portion 411 and the side panel 32 are pushed against the side panel 32. According to this, the air flowing into the vicinity of the side panel 32 flows along the side panel 32 without being separated from the side panel 32.

The centrifugal blower 1 of the present embodiment is capable of limiting the turbulence of the airflow around the side panel 32 by the induced airflow IA generated by the device 61 of the plasma actuator 6. Accordingly, the centrifugal blower 1 of the present embodiment is capable of reducing noise caused by the turbulence of the airflow around the side panel 32 of the impeller 3, and capable of improving blowing effectiveness.

In the present embodiment, the device 61 of the plasma actuator 6 is provided in the rim portion 411*a* of the air intake portion 411 entirely in a circumferential direction. However, a distribution of the device 61 is not limited to this. The device 61 of the plasma actuator 6 may be provided in a part of the rim portion 411*a* of the air intake portion 411, for example.

Fourth Embodiment

Next, a fourth embodiment of the present disclosure will be described below referring to FIGS. 16 to 19. The present embodiment is different from the first embodiment in a point in which the deflection portion is formed of a guide portion 7 opposed to an air intake portion 411.

Figure 16:
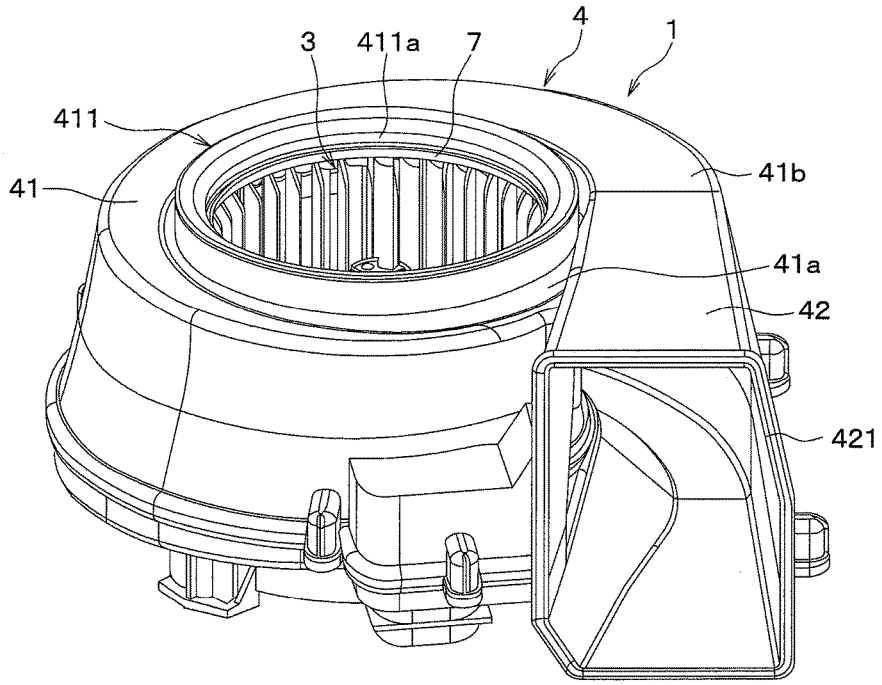
FIG. 16 is a diagram illustrating a centrifugal blower according to a fourth embodiment of the present disclosure.
Figure 17:
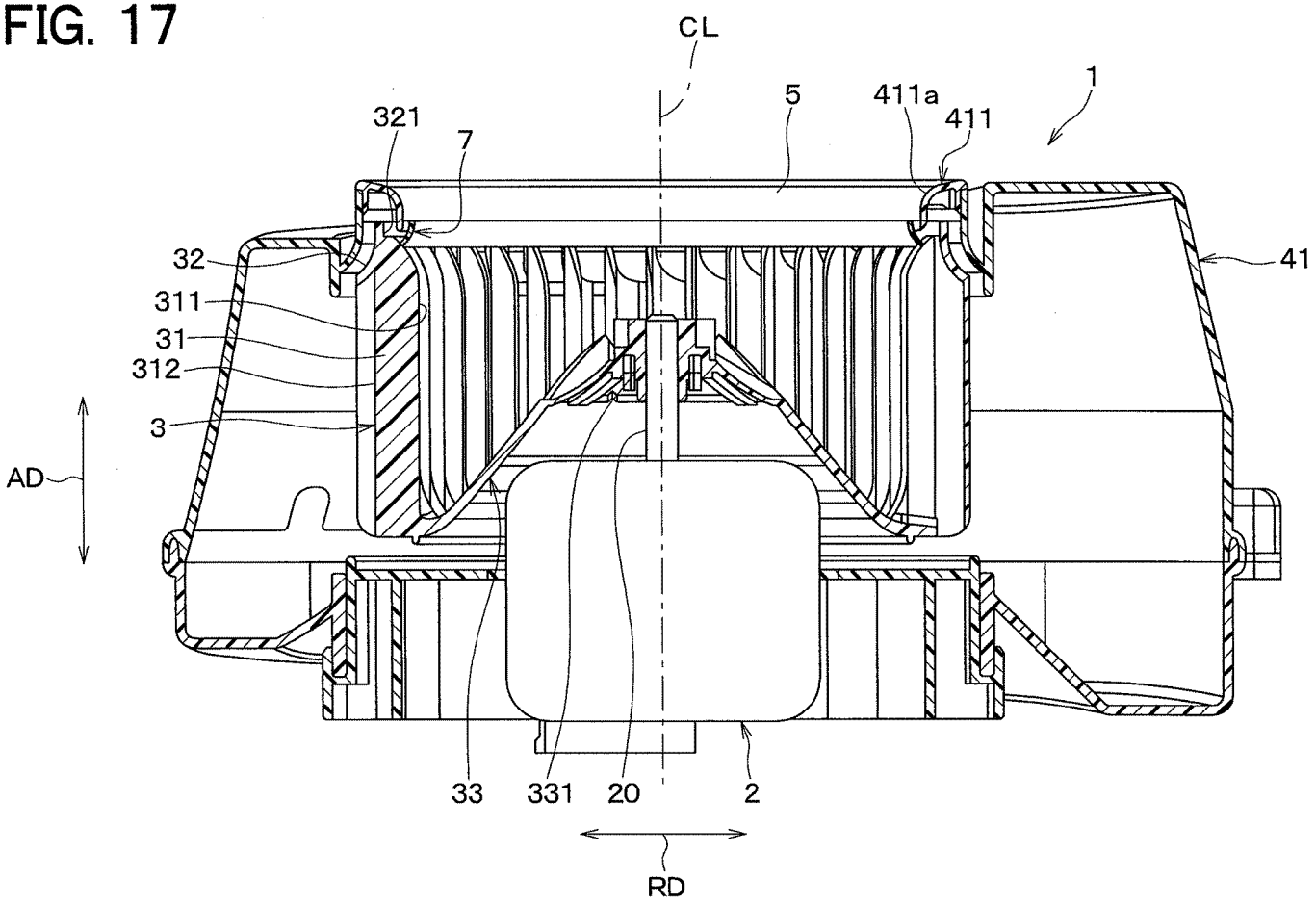
FIG. 17 is a sectional diagram illustrating the centrifugal blower according to the fourth embodiment.

In a centrifugal blower 1 of the present embodiment, the guide portion 7 opposed to an entire circumference of a rim portion 411*a* of an air intake portion 411 is provided as shown in FIG. 16. As shown in FIG. 17, the guide portion 7 is provided inside the air intake portion 411 and formed of a component having an annular shape concentric with the air intake portion 411. The guide portion 7 may be provided inside in a radial direction RD of a rotation shaft 20. The guide portion 7 is supported by the air intake portion 411 through a leg portion.

Figure 18:
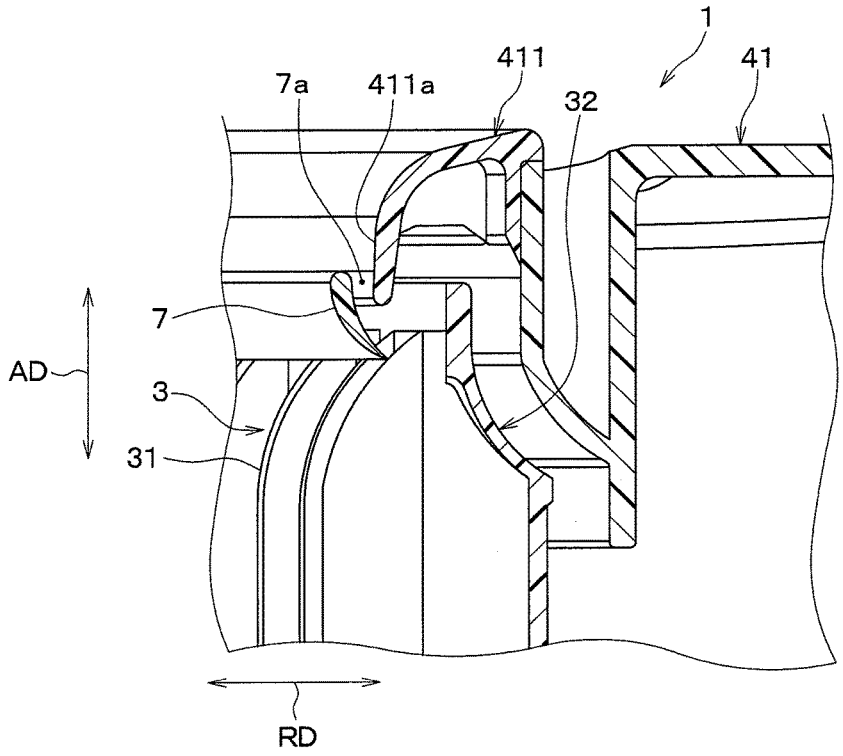
FIG. 18 is a sectional diagram illustrating the centrifugal blower according to the fourth embodiment.

As shown in FIG. 18, an air passage 7*a* having an annular shape is defined between the guide portion 7 and the air intake portion 411. The guide portion 7 is provided such that a gap between the guide portion 7 and the rim portion 411*a* of the air intake portion 411 in the radial direction RD decreases toward a downstream of the airflow.

Specifically, a diameter of the guide portion 7 of the present embodiment increases toward the downstream of the airflow such that air flowing in the air passage 7*a* is blown out along the side panel 32. The guide portion 7 has a curved surface shape, and a cross section of the guide portion 7 in the axial direction AD of the rotation shaft 20 extends outward in the radial direction RD of the rotation shaft 20 toward the downstream of the airflow.

The other configurations are similar to the first embodiment. Next, actuations of the centrifugal blower 1 of the present embodiment will be described below. In the centrifugal blower 1, the impeller 3 rotates according to a rotation of the rotation shaft 20 of an electric motor 2. The air drawn into the impeller 3 from the air intake portion 411 on one side in an axial direction of the rotation shaft 20 is discharged outward in the radial direction RD by centrifugal force.

Figure 19:
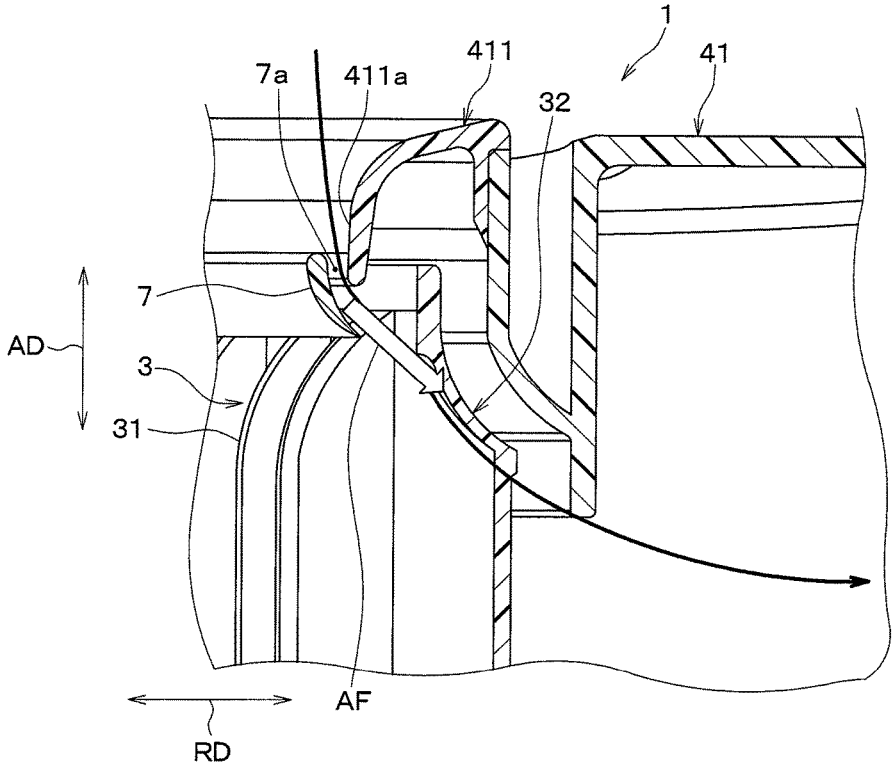
FIG. 19 is a diagram illustrating an airflow around a side panel of the centrifugal blower according to the fourth embodiment.

In this time, the air along the surface of the air intake portion 411 is blown to the vicinity of the side panel 32 through the air passage 7*a* defined between the guide portion 7 and the air intake portion 411, as shown in FIG. 19. An airflow AF blown from the air passage 7*a* pushes, against the side panel 32, the air flowing from the surface of the air intake portion 411 to the vicinity of the side panel 32 and the air returned through a gap between the air intake portion 411 and the side panel 32. Therefore, the air flowing into the vicinity of the side panel 32 flows along the side panel 32 without separating from the side panel 32.

In the centrifugal blower 1, the turbulence of the airflow in the vicinity of the side panel 32 can be limited by the airflow AF blown from the air passage 7*a* between the rim portion 411*a* of the air intake portion 411 and the guide portion 7. Accordingly, the centrifugal blower 1 of the present embodiment is capable of reducing noise caused by the turbulence of the airflow in the vicinity of the side panel 32 of the impeller 3, and capable of improving blowing effectiveness.

In the present embodiment, the guide portion 7 is formed of a component having an annular shape opposed to the rim portion 411*a* of the air intake portion 411 entirely in a circumferential direction. However, the shape of the guide portion 7 is not limited to this. The guide portion 7 may be formed of a component having an arc shape opposed to a part of the rim portion 411*a* of the air intake portion 411.

Although the present disclosure has been fully described in connection with the preferred embodiments thereof with reference to the accompanying drawings, it is to be noted that various changes and modifications will become apparent to those skilled in the art.

In the above described embodiments, the centrifugal blower 1 is installed in an interior unit of an air conditioning device for a vehicle. However, the centrifugal blower 1 is not limited to this. The centrifugal blower 1 can be installed to a seat air conditioning device for a vehicle, for example. The centrifugal blower 1 is not limited to be for a vehicle but can be installed to a stationary air conditioner or a ventilation device.

In the above-described embodiments, the impeller 3 is formed of a multi-blade centrifugal fan (sirocco fan) in which a forward curved blade is used as the blade 31, however, the impeller 3 is not limited to this. The impeller 3 may be formed of a turbofan in which a backward curved blade is used as each blade 31.

In the above-described embodiments, the casing 4 has the scroll portion 41, however, the casing 4 is not limited to this. A 360 degrees blowing type casing 4 that does not include the scroll portion 41 may be adopted.

Additional advantages and modifications will readily occur to those skilled in the art. The disclosure in its broader terms is therefore not limited to the specific details, representative apparatus, and illustrative examples shown and described.

In the above-described embodiments, it is needless to say that components of the embodiments are not essential excepting a case where the component is apparently essential in principle or it is explicitly described to be essential.

In the above-described embodiments, when the number, numerical value, quantity, numerical ranges, etc. of components are mentioned, it is not intended to be limited to the particular number excepting a case where the component is apparently limited to the particular number in principle or it is explicitly described to be essential.

Further, in the above-described embodiments, when the shapes, the positional relationships and the like of the components are mentioned, it is not intended to be limited to the particular shapes or the positional relationships excepting a case where the component is apparently limited to the particular shapes or positional relationships in principle or it is explicitly described to be essential.

According to a first aspect described in a part or whole of the above-described embodiment, the centrifugal blower 1 includes the deflection portion deflecting the air flowing along the surface of the air intake portion to the side panel.

According to a second aspect, the deflection portion of the centrifugal blower 1 includes the vertical vortex generating portion that generates a vertical vortex having a center axis of its rotation in a direction along the main current of the air. The vertical vortex generating portion is provided at least in a part of the rim portion of the air intake portion.

According to this configuration in which the vertical vortex generating portion is provided in the rim portion of the air intake portion, the airflow on the downstream side of the air intake portion is pushed against the side panel by the vertical vortex generated at the rim portion of the air intake portion. Therefore, the separation of the airflow along the surface of the air intake portion can be limited, and accordingly it becomes possible to flow the airflow along the surface of the air intake portion along the side panel.

According to a third aspect, the vertical vortex generating portion of the centrifugal blower 1 includes a plurality of tooth portions, the tooth portion having a triangle shape. The top end portion of the tooth portion in which the two sides intersects each other is positioned upstream of the base portion contacting the rim portion of the air intake portion. The tooth portion is provided in the rim portion of the air intake portion in a state where the tooth portion is tilted such that the top end portion is located inside in the radial direction of the rotation shaft compared to the base portion. According to this, the two sides of each tooth portion generate the vertical vortex when the air flowing along the rim portion of the air intake portion passes the tooth portion having a triangle shape.

According to a fourth aspect, the vertical vortex generating portion of the centrifugal blower 1 includes a plurality of protrusion portions having a three sided pyramid shape protruding inward from the rim portion of the air intake portion in the radial direction of the rotation shaft. The protrusion portion includes the two sides in the downstream surface positioned downstream of the airflow, the two sides intersecting with the main current of the air. According to this, the vertical vortex can be generated at the two sides of each protrusion portions when the air flowing along the rim portion of the air intake portion passes the protrusion portion having the three sided pyramid shape. The two sides of the downstream surface may correspond to two edges of the three sided pyramid shape.

According to a fifth aspect, the deflection portion of the centrifugal blower 1 includes the plasma actuator generating the induced airflow toward the side panel by generating plasma. The plasma actuator includes the device and the alternating current supplying portion. The device includes the non-conductive body, the first side electrode provided on the first side of the non-conductive body, and the second side electrode provided on the second side of the non-conductive body. The alternating current supplying portion supplies an alternating-current voltage between the first side electrode and the second side electrode. The device is provided at least in a part of the rim portion of the air intake portion.

Since the plasma actuator is provided in the rim portion of the air intake portion, the airflow on the downstream side of the air intake portion is pushed against the side panel by the induced airflow generated by the rim portion of the air intake portion. Therefore, the separation of the air flowing along the surface of the air intake portion is suppressed, and accordingly the air flowing along the surface of the air intake portion is capable of flowing along the side panel.

According to a sixth aspect, the deflection portion includes the guide portion opposed to the rim portion of the air intake portion. The guide portion defines the air passage in which the air flows toward the side panel. The air passage is defined between the guide portion and the rim portion of the air intake portion. A gap in the radial direction of the rotation shaft between the guide portion and the rim portion of the air intake portion becomes small toward the downstream of the airflow.

The air on the downstream side of the air intake portion is pushed against the side panel by the airflow blown from the air passage between the guide portion and the rim portion of the air intake portion. Therefore, the separation of the air flowing along the surface of the air intake portion can be suppressed, and accordingly the air flowing along the surface of the air intake portion is capable of flowing along the side panel.

What is claimed is:

1. A centrifugal blower comprising:

a rotation shaft;

an impeller having a circular cylindrical shape and rotating about an axis line of the rotation shaft to draw air therein in an axial direction of the rotation shaft and discharge the air outward in a radial direction of the rotation shaft, the impeller including a plurality of blades arranged radially about the rotation shaft, and a side panel having an annular shape and connecting end parts of the plurality of blades in the axial direction of the rotation shaft;

a casing accommodating the impeller and including an air intake portion positioned adjacent to the side panel, the air intake portion having a bell mouth shape to have a rim portion that defines an opening through which the drawn air is guided to an inside of the impeller; and a deflection portion deflecting an airflow along the rim portion of the air intake portion toward the side panel, wherein the deflection portion includes a vertical vortex generating portion generating a vertical vortex that has a center axis of rotation, the center axis extending in a direction along a main current of the air, the vertical vortex generating portion is provided in at least a part of the rim portion of the air intake portion, the vertical vortex generating portion includes a plurality of tooth portions each of which has a triangle shape, each tooth portion is provided in the rim portion of the air intake portion, the tooth portion including a top end portion at which two sides of the tooth portion intersect each other and a base portion contacting the rim portion of the air intake portion, wherein the top end portion is located inside a most inside part of the base portion in the radial direction of the rotation shaft, and each tooth portion is tilted such that the top end portion is located upstream of the base portion with respect to the airflow, the top end portion being located inside the base portion in the radial direction of the rotation shaft.

2. The centrifugal blower according to claim 1, wherein the side panel is located outside the plurality of blades in the radial direction of the rotation shaft.

3. The centrifugal blower according to claim 1, wherein the plurality of tooth portions are joined to an edge of the air intake portion.

4. A centrifugal blower comprising:

a rotation shaft;

an impeller having a circular cylindrical shape and rotating about an axis line of the rotation shaft to draw air therein in an axial direction of the rotation shaft and discharge the air outward in a radial direction of the rotation shaft, the impeller including a plurality of blades arranged radially about the rotation shaft, and a side panel having an annular shape and connecting end parts of the plurality of blades in the axial direction of the rotation shaft;

a casing accommodating the impeller and including an air intake portion positioned adjacent to the side panel, the air intake portion having a bell mouth shape to have a rim portion that defines an opening through which the drawn air is guided to an inside of the impeller; and a deflection portion deflecting an airflow along the rim portion of the air intake portion toward the side panel, wherein the deflection portion includes a vertical vortex generating portion generating a vertical vortex that has a center axis of rotation, the center axis extending in a direction along a main current of the air, the vertical vortex generating portion is provided in at least a part of the rim portion of the air intake portion, the vertical vortex generating portion includes a plurality of protrusion portions each of which has a three sided pyramid shape and protrudes inward in the radial direction of the rotation shaft from the rim portion of the air intake portion, and the protrusion portion includes a downstream surface located on a downstream side of the protrusion portion in the direction along the main current of the air, the downstream surface including two sides intersecting with the main current of the air.

5. The centrifugal blower according to claim 4, wherein the protrusion portion has a vertex at which three surfaces of the protrusion portion other than a bottom surface contacting the rim portion intersect each other, and the vertex is located downstream of the bottom surface in a flow direction of the air.

* * * * *